US005152204A

United States Patent [19]

Trevizo

[11] Patent Number: 5,152,204

[45] Date of Patent: Oct. 6, 1992

[54] CLAM SHELL DIE CUTTER

[76] Inventor: Jose Trevizo, 434 Auburn Ave., San Marcos, Calif. 92069

[21] Appl. No.: 789,783

[22] Filed: Nov. 8, 1991

Related U.S. Application Data

[63] Continuation of Ser. No. 346,406, May 2, 1989, abandoned.

[51] Int. Cl.[5] ..... B26D 3/00

[52] U.S. Cl. ..... 83/55; 83/564; 83/566; 83/698; 83/733; 83/856; 83/411.4; 72/446; 72/462; 72/481; 100/233

[58] Field of Search ..... 83/698, 699, 700, 856, 83/857, 858, 532, 533, 535, 564, 566, 567, 733, 13, 55, 410.7, 410.8, 411.3, 411.4; 72/446, 462, 481; 100/98 R, 233

[56] References Cited

U.S. PATENT DOCUMENTS

| | | | |
|---|---|---|---|
| 3,079,846 | 3/1963 | Ford . | |
| 3,589,230 | 6/1971 | Neuman | 83/700 X |
| 3,782,166 | 1/1974 | Whistler, Jr. et al. | 83/698 X |
| 4,274,332 | 6/1981 | Nakamura | 72/481 X |
| 4,602,497 | 7/1986 | Wallis | 72/462 |
| 4,698,894 | 10/1987 | Lingaraju et al. | 72/446 X |

FOREIGN PATENT DOCUMENTS

| | | | |
|---|---|---|---|
| 350957 | 3/1922 | Fed. Rep. of Germany . | |
| 3738196 | 5/1989 | Fed. Rep. of Germany | 83/698 |
| 2151854 | 4/1973 | France . | |
| 629451 | 10/1949 | United Kingdom . | |

*Primary Examiner*—Frank T. Yost
*Assistant Examiner*—Eugenia A. Jones

[57] ABSTRACT

An improvement is made to a die cutting press and to the method of die cutting in a press by providing two opposing and oppositely driven clamping bars which move together to clamp the die board and to accurately position the clamped die board at a predetermined location within the press. The press is operated to determine the adequacy of the cut produced by the die in sheet material fed into the press. If the cut is unsatisfactory, the opposing clamp bars are quickly driven apart thereby releasing the die board. The die board can be removed from the press and then manipulated or modified to cure any imperfection in the cut. The modified die board is then reinserted into the press and accurately repositioned at the predetermined location within the press by driving the opposing clamping bars towards each other against the die board. The drive mechanism of the clamping bars insures that when the die board is securely clamped, the die board will always be accurately repositioned in the same press at exactly the location assumed by the die board when it was inserted. The opposing moving clamps automatically move the die board to the predetermined position without the need for measurement, registration or concern for variations in tolerances within a jig.

10 Claims, 3 Drawing Sheets

CLAM SHELL DIE CUTTER

This is a continuation of co-pending application Ser. No. 07/346,406 filed on May 2, 1989, now abandoned.

BACKGROUND OF THE INVENTION

1. Field of the Invention

The invention relates to an apparatus and method for die cutting in a press and in particular to die cutting cardboard in a clam shell press.

2. Description of the Prior Art

Containers and cartons are manufactured by die cutting, sometimes with intricate shapes. In the basic die-cutting process sharp metal edges in the form of a die are brought with pressure against a cardboard surface to cut through the cardboard and are then retracted. When cutting complex shapes in corrugated cardboard, a substantial amount of pressure must be brought on the die to cut through the cardboard and the knife edge of the die must be forced into the cardboard, which in turn is forced with extreme accuracy through the cardboard against a solid backing plate, typically within a few thousandths of an inch.

As the knives of the die wear or when the die is originally made ready, a displacement of the knife edges even by a few thousandths of an inch causes the cut through the cardboard to be unclean and the product becomes unusable. A "make ready" process must be performed wherein portions of the die knife edges are shimmed by layers of adhesive tape. Cardboard tape of a few thousandths of an inch or metal shims ranging from one to ten thousandths of an inch are placed between selected portions of the die's rear edge and the surface of the press and are used to cleanly force the die into the cardboard. The make-ready process must be practiced to both to set up the die when first cutting and to adjust the die as it wears during a cutting project. If the make ready process is not at first successful, the die must be removed from the press readjusted and again tested until satisfactorily adjusted. This is a process which can be time consuming even for a skilled press operator.

A method and apparatus are needed whereby this make-ready process can be simplified.

BRIEF SUMMARY OF THE INVENTION

The invention is an improvement in a die cutting press for cutting sheet material comprising a die for cutting the sheet material. A first mechanism provides support for the die. A second mechanism is adapted for pressing the sheet material against the die. The sheet material is cut by the die. A clamping mechanism temporarily fixes the die supported by the first mechanism. The clamping mechanism is operable to selectively and quickly release and clamp the die to allow removal, manipulation and insertion of the die onto the first mechanism.

As a result, the die may be readily manipulated to perfect cutting of the sheet by the die.

In the first embodiment the clamping mechanism is comprised of a first and second clamping bar and a motive mechanism for simultaneously displacing the first and second bars in opposing directions to selectively bring the first and second bars together or to draw the first and second bars apart.

The first and second bars each comprise generally straight cross bars and the first mechanism for providing support for the die is a generally flat surface. The first and second cross bars are displaced by the motive mechanism across the flat surface of the first mechanism.

In the second embodiment the first and second bar are at least partial rings and the first mechanism is a cylinder. The first and second rings are displaced by the motive mechanism along the axial length of the cylinder.

In the first embodiment the motive mechanism comprises a first and second drive screw. The first and second drive screws are threaded to opposing first and second ends of the first and second cross bars. The drive screw has two threaded portions. The threaded portions of each drive screw have an opposite screw direction so that rotation of the drive screw displaces the cross bars in opposing directions.

The motive mechanism further comprises a connection mechanism for connecting the first and second drive screws so that rotation of one drive screw causes rotation of the other drive screw.

In the first embodiment the connection mechanism comprises a sprocket affixed to each drive screw and a chain engaging each sprocket of each drive screw and disposed therebetween so that rotation of one drive screw rotates its corresponding sprocket, displaces the chain and rotates the other sprocket to rotate the other drive screw.

In the first embodiment the press is a clam shell press; the first mechanism for providing support to the die comprises a stationary frame; and the second mechanism adapted for pressing a sheet against the die comprises a movable bridge. The bridge is adapted for pressing against the frame. The first and second cross bars and motive mechanism for displacing the cross bars are coupled to the frame.

In the second embodiment the press is a rotary press. The first mechanism for providing support to the die is a cylinder. The rings are disposed on the cylinder and displaced by the motive mechanism along the axis of the cylinder. The second mechanism adapted for pressing the sheet against the die is a pressure cylinder characterized by a conformable portion of its surface. The portion is selectively brought into contact with the sheet when the sheet is disposed in contact with the die.

The invention is also a method for adjusting a die within a press for cutting a sheet by the die comprising the steps of disposing the die in the press, and positioning the die in the press by simultaneous movement of two opposing clamping mechanism cutting the sheet by the die.

As a result, the die is quickly and easily adjusted at the predetermined position within the press.

The method further comprises the steps of examining the cut sheet for a satisfactory cut, and releasing the die from the press by moving the two opposing clamping mechanism away from each other. The die is adjusted to improve the cut provided by the die in the sheet. The die is repositioned into the press by simultaneous opposing movement of the two opposing clamping mechanism against the die. The die is accurately repositioned at the predetermined position.

The step of positioning the die accurately at the predetermined position comprises the steps of simultaneously driving two straight cross bars toward each other with the die disposed between the cross bars and clamped therebetween thereby limiting further movement of the cross bars and thereby accurately positioning the die in the predetermined position.

In a second embodiment of the method the step of accurately positioning the die at the predetermined position comprises the steps of simultaneously displacing two rings along the length of a cylindrical press member. The die is disposed between the two rings and is securely clamped by the two rings when the die is accurately positioned at the predetermined position.

In the first embodiment the step of releasing comprises the steps of simultaneously driving two straight cross bars away from each other and the step of repositioning comprises simultaneously driving again the two straight cross bars toward each other and limiting further movement of the cross bars thereby accurately positioning the die in the predetermined position.

In the second embodiment the step of releasing comprises the step of simultaneously displacing two rings along the length of a cylindrical press member away from each other, and the step of repositioning comprises the step of simultaneously again displacing two rings along the length of a cylindrical press member toward each other. The die is disposed between the two rings and is securely clamped by the two rings when the die is accurately positioned at the predetermined position.

The invention is still further characterized as an improvement in a clam shell press having a stationary frame for supporting a die member at a predetermined position and a movable bridge for pressing sheet material against the die member causing the die member to cut into the sheet material. The improvement comprises a clamping mechanism for selectively and securely, but temporarily, accurately fixing the die at a predetermined position within the press. A motive mechanism selectively operates the clamping mechanism to clamp the die at the predetermined position or to release the die from the press.

As a result, the die may be repeatedly fixed and removed from the press for adjustment, refixed, tested and readjusted until a satisfactory cut of the sheet is obtained.

The invention and its various embodiments can best be visualized by now turning to the following drawings.

The invention and its various embodiments may be better understood by now turning to the following detailed description.

DETAILED DESCRIPTION OF THE PREFERRED EMBODIMENT

An improvement is made to a die cutting press and to the method of die cutting in a press by providing two opposing and oppositely driven clamping bars which move together to clamp the die board and to accurately position the clamped die board at a predetermined location within the press. The press is operated to determine the adequacy of the cut produced by the die in sheet material fed into the press. If the cut is unsatisfactory, the opposing clamp bars are quickly driven apart thereby releasing the die board. The die board can be removed from the press and then manipulated or modified to cure any imperfection in the cut. The modified die board is then reinserted into the press and accurately repositioned at the predetermined location within the press by driving the opposing clamping bars towards each other against the die board. The drive mechanism of the clamping bars insures that when the die board is securely clamped, the die board will always be accurately repositioned in the same press at exactly the location assumed by the die board when it was inserted. The opposing moving clamps automatically move the die board to the predetermined position without the need for measurement, registration or concern for variations in tolerances within a jig.

Figure 1:
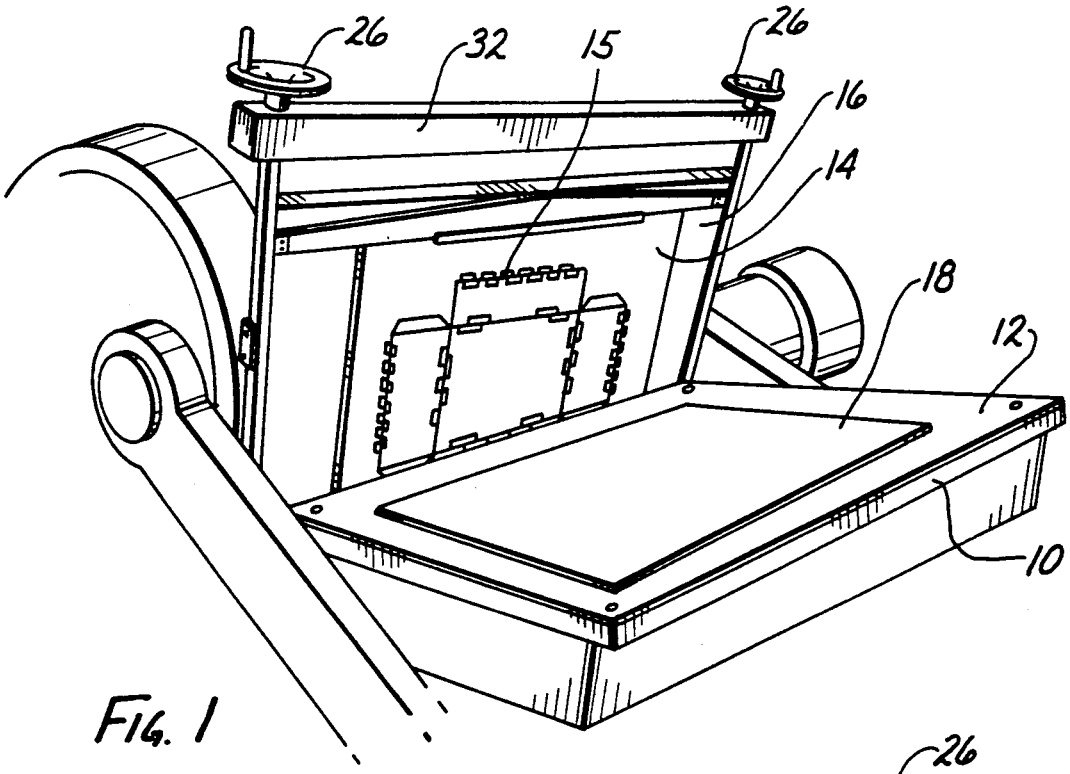
FIG. 1 is a front perspective view of an open clam shell press depicting the overall structure of the improvement to the press.

Turn now to the perspective view of FIG. 1 which shows the invention in a first embodiment incorporated within a clam shell die press. A first rigid metal bridge 10 is provided with a facing metal plate 12 which is about one eighth of an inch thick. Bridge 10 may be one or two inches thick. The die board 14 is bolted to a frame 16 which is a similar rigid metal plate of one or two inches in thickness. A cardboard sheet 18, which is to be cut, is placed between bridge 10 and frame 16 and then bridge 10 is driven upward against frame 16 by the mechanism of the press (not shown) to cut the die pattern of die 15 through cardboard 18.

However, the upper cutting edges of die 15 is almost never perfectly leveled and must be adjusted by shims. The shimming process is a process reminiscent of the princess and pea under the mattress, the smallest adjustment or misadjustment can often be noticed. A thin piece of cardboard or shim is placed between these plates 10 and 12 underneath that portion of plate 12 which will be proximate to or adjacent to a selected knife-edge portion of die 15. If the shim is in the correct position and has the correct thickness, the cutting action of the die into cardboard sheet 18 will be appropriately adjusted, leaving a clean cut.

Die-cut patterns are sometimes exceedingly intricate, e.g., when they include cut-outs, perforations and curvilinear edges. The position of the shim between facing plate 12 and bridge 10 must be measured or positioned rather painstakingly in order to place it under the appropriate portion knife-edge of die 15 which is bolted to frame 16 when the press closes.

When die board 14 is removed from the press after a portion of the job is run and then reinserted to finish the job, it must be repositioned on frame 16 and the position of shims underneath plate 12 remeasured with respect to the assumed, predetermined position of die 15 on frame 16. Die board 14 once attached then detached and reattached almost never ends up exactly in its original position with respect to shims which have been removed along with die board 14 in any case. The normal tolerances in the threading or bolt which attaches die board 14 to frame 16 are typically sufficient to render any prior adjustment suspect or even useless.

The invention is an improvement in a die 15 cutting press 10 shown in FIG. 1 for cutting sheet material 18 comprising a die 15 15 for cutting sheet material 18. A first mechanism 14, 16 provides support for die 15. A second mechanism 16, 12 is adapted for pressing sheet material 18 against die 15. The sheet material 18 is cut by the die 15. A clamping mechanism 26, 22, 24, 20 temporarily fixes die 15 supported by the first mechanism. The clamping mechanism is operable to selectively and quickly release and clamp die 15 to allow removal, manipulation and insertion of die 15 onto the first mechanism. As a result, the die 15 may be readily manipulated to perfect cutting of the sheet by the die 15.

Figure 2:
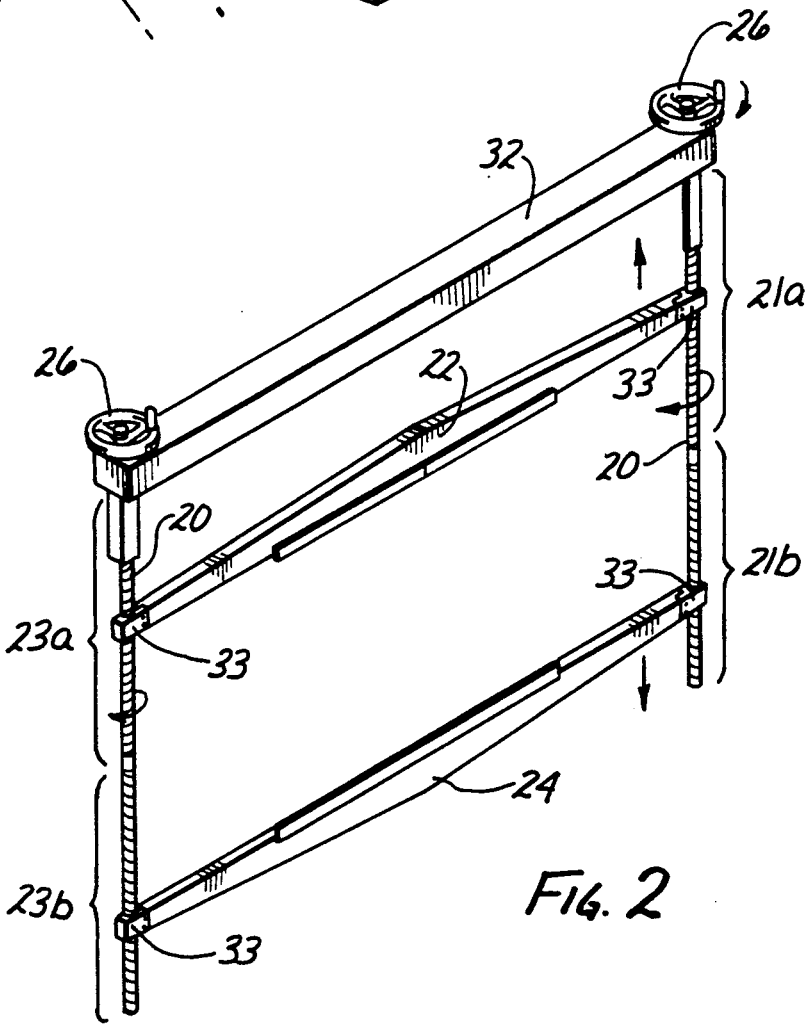
FIG. 2 is a perspective view of the screw driven clamping mechanism installed in the clam shell press as shown in FIG. 1.

In the first embodiment shown in FIG. 2 the clamping mechanism is comprised of a first and second clamping bar 22, 24 and a motive mechanism 26, 20 for simultaneously displacing the first and second bars in opposing directions to selectively bring the first and second bars together or to draw the first and second bars apart.

The first and second bars 22 and 24 each comprise generally straight cross bars and the first mechanism 14, 16 for providing support for die 15 is a generally flat surface. The first and second cross bars are displaced by the motive mechanism across the flat surface of the first mechanism.

In the first embodiment the motive mechanism comprises a first and second drive screw 20. The first and second drive screws 20 are threaded to opposing first and second ends of the first and second cross bars 22 and 24. Each drive screw has two threaded portions 23*a*, *b* and 21*a*, *b*. The threaded portions 21*a*, *b* and 23*a*, *b* of each drive screw 20 have an opposite screw direction so that rotation of the drive screw 20 displaces the cross bars 22, 24 in opposing directions.

The motive mechanism 26, 28, 30 further comprises a connection mechanism 30 for connecting the first and second drive screws so that rotation of one drive screw causes rotation of the other drive screw.

Figure 3:
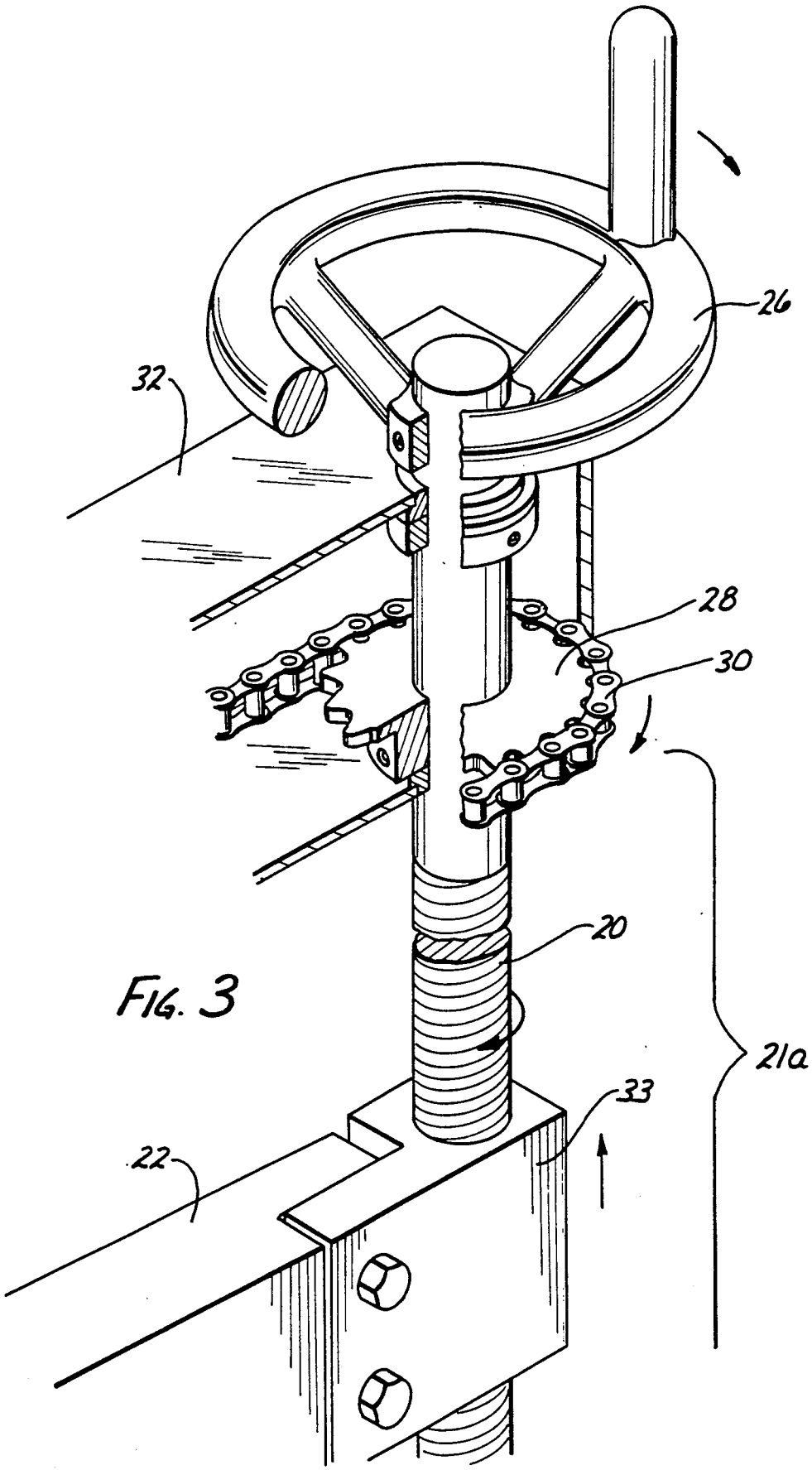
FIG. 3 is an enlarged partially cutaway view of the driving mechanism of the drive screw of the mechanism illustrated in FIG. 2.

In the first embodiment the connection mechanism 28, 30 shown in FIG. 3 comprises a sprocket 28 affixed to each drive screw 20 and a chain 30 engaging each sprocket 28 of each drive screw 20 and disposed therebetween so that rotation of one drive screw 20 rotates its corresponding sprocket 28, displaces chain 30 and rotates the other sprocket 28 to rotate the other drive screw 20.

The invention is also a method for adjusting a die 15 within a press 10 for cutting a sheet 18 by die 15 comprising the steps of disposing die 15 in press 10, positioning die 15 in press 10 by simultaneous movement of two opposing clamping mechanisms, and cutting the sheet by die 15. As a result, die 15 is quickly and easily adjusted at the predetermined position within press 10.

The method further comprises the steps of examining the cut sheet for a satisfactory cut, and releasing die 15 from press 10 by moving the two opposing clamping mechanisms away from each other. Die 15 is adjusted to improve the cut provided by the die 15 in the sheet. Die 15 is repositioned into press 10 by simultaneous opposing movement of the two opposing clamping mechanisms against die 15. Die 15 is accurately repositioned at the predetermined position.

The step of positioning die 15 accurately at the predetermined position comprises the steps of simultaneously driving two straight cross bars toward each other with die 15 disposed between the cross bars and clamped therebetween thereby limiting further movement of the cross bars and thereby accurately positioning die 15 in the predetermined position.

In the first embodiment the step of releasing comprises the steps of simultaneously driving two straight cross bars away from each other and the step of repositioning comprises simultaneously driving again the two straight cross bars toward each other and limiting further movement of the cross bars thereby accurately positioning the die 15 in the predetermined position.

The shims are applied directly to the back of the die according to the cut pattern in the cardboard.

The method works quite well and allows very small runs, as small as few hundred cartons, to be die-cut in a profitable manner which was not previously possible when die adjustments had to be handled as described in connection with FIG. 1.

Sprockets 28 and chain drive 30 are concealed from view in FIGS. 1 and 2 by means of casing 32 disposed horizontally across the top of frame 16. As shown in FIG. 3, the drive screw is journalled in casing 32 and fixed to sprocket 28. Rotation of hand wheel 26 rotates sprocket 28 and displaces chain 30, thereby rotating the opposite or left drive rod 20 as seen in the Figures. Each drive rod 20 continues downwardly from casing 32 and is threaded into block 33. Block 33 in turn is connected or bolted in FIG. 3 to cross bar 22. As better depicted in FIG. 2, each drive rod 20 continues downwardly to a similar block 33 into which is it is threaded. Lower blocks 33 are also bolted or connected to the lower cross bar 24. Die board 14, carrying the cutting die 15, is then easily clamped and centered on frame 16 by cross bars 22 and 24.

Therefore, when the right hand handwheel 26 as seen in FIG. 2 is rotated in a clockwise direction, lead rod 20 also rotates in a clockwise direction. The upper portion 21*a* of lead rod 20 has a lefthand thread machined therein so that clockwise rotation of rod 20 causes upper crossbar 22 to move upwardly. Lower portion 21*b* of the threading defined in lead rod 20 has a right-hand thread defined therein so that clockwise rotation of lead rod 20 causes lower cross bar 24 to move downwardly as depicted in FIG. 2. Threaded portions 21*a* and 21*b* are defined in equal portions of lead rod 20, allowing for a range of adjustments of cross bars 22 and 24 from the center of the mechanism of FIG. 2 to the outward extremities of threaded portions 21*a* and 21*b*.

Similarly, the left hand screw drive 20 as seen in FIG. 2 is provided with an upper threaded portion or half 23*a* and a lower threaded portion or half 23*b*. Clockwise rotation of the right screw drive 20 in FIG. 2 will similarly be translated through chain 30 in casing 32 to cause a clockwise rotation of the left side screw drive 20 in FIG. 2. Thus, threaded portion 23*a* is a left hand screw cut while threaded portion 23*b* is a right hand screw cut therefore driving each end of cross bars 22 and 24 simultaneously and uniformly in the same direction. This allows for even pressure to be applied by cross bars 22 and 24 against the upper and lower edges of die board 14 in FIG. 1.

Figure 4:
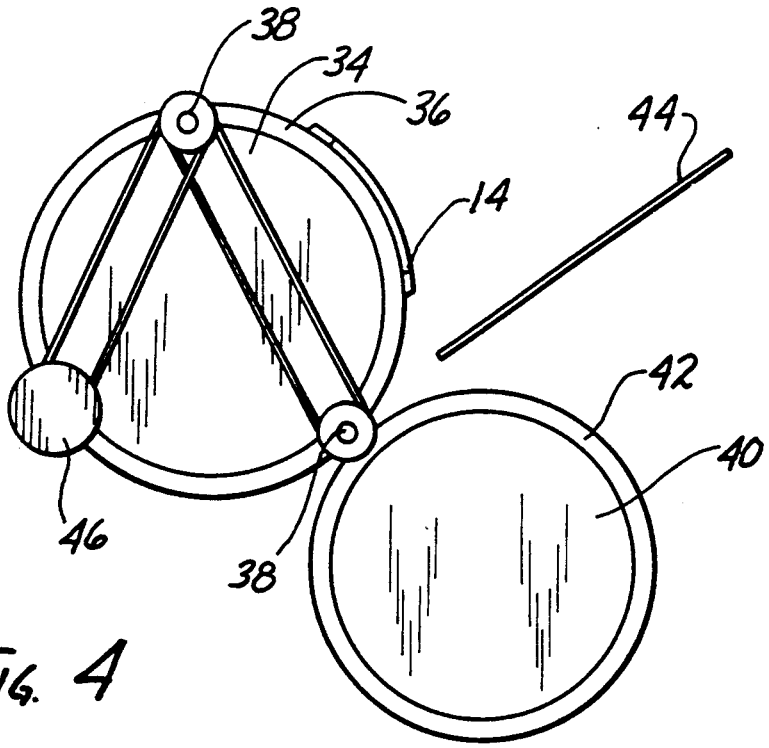
FIG. 4 is a side diagrammatic view of a second embodiment of the invention incorporated in a rotary press.
Figure 5:
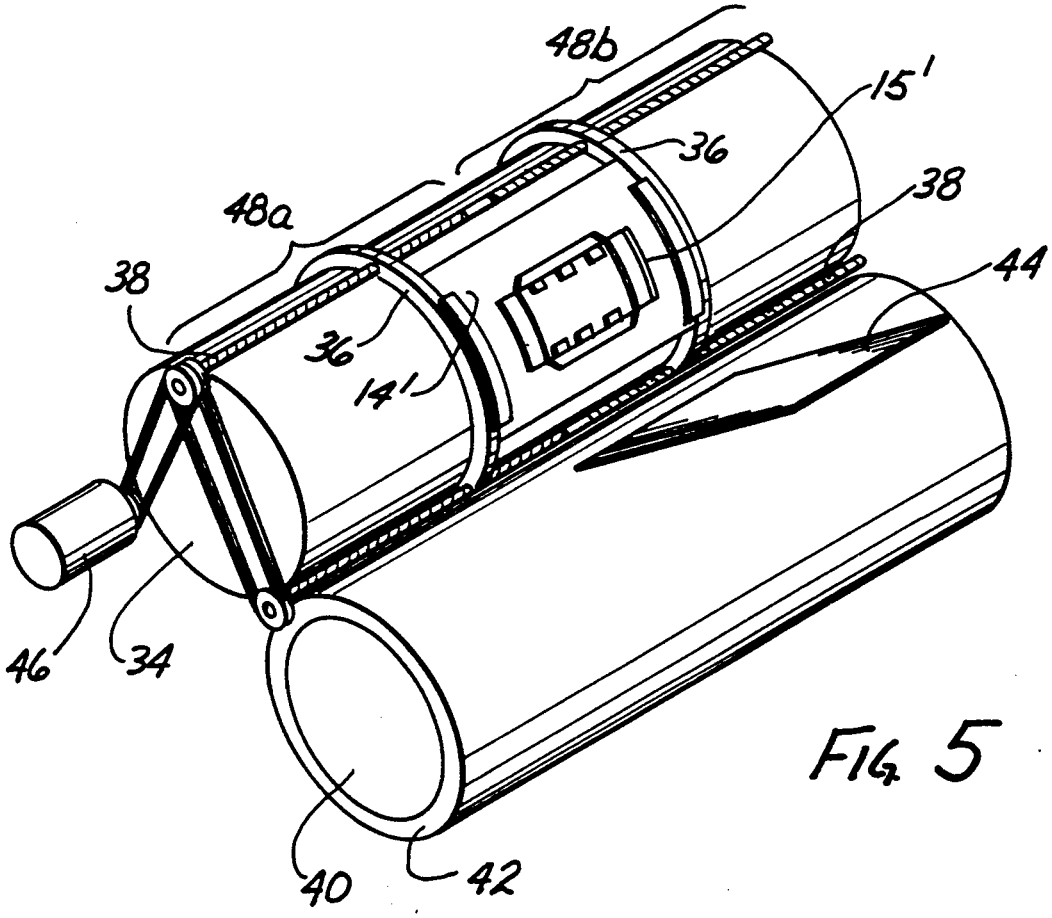
FIG. 5 is a perspective view of the embodiment of FIG. 4.

FIGS. 4 and 5 show a press which is a rotary press. The same concept of FIGS. 1–3 can be applied according to the teachings of the invention to a rotary die cutter. Here the die boards are cylindrical and instead of being bolted to the roller as in the prior art, the die board is clamped into the press by two slidable rings 36, one of which is shown in FIG. 4 and both of which are visible in the perspective view of FIG. 5. Rings 36 are driven by longitudinal screw rods 38 which are ganged together by chains and sprockets, or beveled gears and shafts as desired. Such screw rods 38 would be driven appropriately through a pneumatic air ratcheting mechanism 46 attached to the driving chain or driveshaft coupled to screw rods 38. In the embodiment of FIGS.

4 and 5 die board 14′ on rotor 34 is pressed against a pinch roller 40 about which is wrapped a tough urethane blanket 42. A cardboard sheet 44 to be cut is inserted therebetween. Again, a few thousandths of an inch shimming is necessary to make ready die board 14′. As before, the shimming is inserted at the back of die board 14′ between die board 14′ and roller 34 instead of under polyurethane blanket 42 and die board 14′ is quickly positioned and repositioned by clamping rather than by bolting or other type of affixation to roller 34.

Many modifications and alterations may be made by those having ordinary skill in the art without departing from the spirit and scope of the invention. Therefore, the illustrated embodiments have been set forth only for the purposes of example and should not be taken as limiting the scope of the invention as defined in the following claims.

I claim:

1. A method for adjusting a keyless die means within a press for cutting a sheet by said die means comprising the steps of:

disposing said keyless die means in said press; and positioning said keyless die means in said press by simultaneous movement of two opposing clamping bars against opposing sides of said keyless die means, said opposing sides having a lineal extent, said two opposing clamping bars being driven by two parallel and spaced-apart screw drives to clamp said keyless die means along the entire lineal extent of said opposing sides between said bars at a repeatably and accurately defined position in said press; and cutting said sheet by said keyless die means, whereby said keyless die means is quickly and easily adjusted at said defined position within said press.

2. The method of claim 1 further comprising the steps of:

examining said cut sheet for a satisfactory cut;

releasing said keyless die means from said press by moving said two opposing clamping bars away from each other;

adjusting said keyless die means to improve the cut provided by said keyless die means in said sheet;

repositioning said keyless die means into said press by simultaneous opposing movement of said two opposing clamping bars against said opposing sides of said keyless die means, said keyless die means being accurately repositioned at said defined position.

3. The method of claim 2 wherein said step of releasing comprises the steps of simultaneously driving said two opposing clamping bars away from each other and said step of repositioning comprises simultaneously driving again said two opposing clamping bars toward each other and limiting further movement of said opposing clamping bars thereby accurately positioning said keyless die means in said defined position.

4. The method of claim 1 where said step of positioning said keyless die means accurately at said defined position comprises the steps of simultaneously driving said two opposing clamping bars toward each other with said keyless die means disposed between said opposing clamping bars and being clamped therebetween, and limiting further movement of said opposing clamping bars thereby accurately positioning said keyless die means in said defined position.

5. An improvement in a die cutting press for cutting sheet material comprising:

a keyless die means for cutting said sheet material, said die means having opposing sides with lineal extent;

first means for providing support for said keyless die means;

second means adapted for pressing said sheet material against said keyless die means, said sheet material being cut by said keyless die means;

clamping means for temporarily fixing said keyless die means supported by said first means, said clamping means being operable to selectively and quickly release and clamp said keyless die means to allow removal, manipulation and insertion of said keyless die means onto said first means, wherein said clamping means is comprised of a first and second clamping bar extending across the entire opposing sides of said keyless die means, and motive means for simultaneously displacing said first and second bars in opposing directions to selectively bring said first and second bar together or to draw said first and second bar apart, wherein said first and second bar comprise generally straight cross bars, said first and second cross bars being displaced by said motive means across said first means, and wherein said motive means comprises first and second parallel drive screws, said first and second parallel drive screws being threaded to opposing first and second ends of said first and second cross bars, each of said parallel drive screws having two threaded portions, said threaded portions of each parallel drive screw having an opposite screw direction so that rotation of said parallel drive screws simultaneously displace said cross bars in opposing directions to repeatably and accurately position said keyless die means within said press, whereby said keyless die means may be readily manipulated to perfect cutting of said sheet material by said keyless die means.

6. The improvement of claim 1 wherein said motive means further comprises connection means for connecting said first and second drive screws so that rotation of said first drive screws causes rotation of said second drive screw.

7. The improvement of claim 6 wherein said connection means comprises a sprocket affixed to each drive screw and a chain engaging each sprocket of each drive screw and disposed therebetween so that rotation of said first drive screw rotates its corresponding sprocket, displaces said chain and rotates said other sprocket to rotate said second drive screw.

8. The improvement of claim 1 wherein said press is a clam shell press, said first means for providing support to said die means comprises a stationary frame, wherein said second means adapted for pressing a sheet against said die means comprises a movable bridge, said bridge being adapted for pressing against said frame, and wherein said first and second clamping bars and said motive means for displacing said clamping bars are coupled to said frame.

9. An improvement in a clam shell press having a stationary frame for supporting a keyless die member having a lineal extent along opposing sides, said keyless die member being supported at a defined position and a movable bridge for pressing sheet material against said die member causing said die member to cut into said sheet material, the improvement comprising:

clamping means for selectively and securely but temporarily accurately fixing said keyless die member at a defined position within said press, wherein said clamping means comprises a first and second opposing bar; and motive means for selectively operating said clamping means to clamp said keyless die member at said defined position or to release said keyless die member from said press, wherein said motive means is operative to drive said first and second opposing bars simultaneously in opposite directions with respect to each other, wherein said first and second bars are fixed to said frame and wherein said motive means comprises:

first and second opposing and parallel drive screws, said first and second parallel drive screws threadably coupled to opposing ends of both said first and second bars, said first and second parallel drive screws being simultaneously driven to move said first and second bars in opposing directions on said frame to clamp or release said keyless die member; and means coupling said first and second parallel drive screws for transferring rotary motion from said first parallel drive screw to said second parallel drive screw to simultaneously and synchronously rotate said first and second parallel drive screws, whereby said keyless die member may be repeatedly fixed and removed from said press for adjustment, refixed, tested and readjusted until a satisfactory cut of said sheet is obtained.

10. The improvement of claim 9 wherein said clamping means is fixed to said frame.

* * * * *